US005804272A

United States Patent [19]

Schrader

[11] Patent Number: 5,804,272

[45] Date of Patent: Sep. 8, 1998

[54] BACKSPIN STICKER

[76] Inventor: Gunter Schrader, 13 Broadmoor Rd., Rotunda West, Fla. 33947

[21] Appl. No.: 819,567

[22] Filed: Mar. 14, 1997

[51] Int. Cl.[6] ..... A63B 53/04

[52] U.S. Cl. ..... 428/40.1; 428/149; 473/330

[58] Field of Search ..... 428/40.1, 149, 428/143; 473/324, 330, 342

[56] References Cited

U.S. PATENT DOCUMENTS 2,732,065 1/1956 Marchese ..... 428/43

4,768,787 9/1988 Shira ..... 473/330

4,917,384 4/1990 Caiati ..... 473/330

*Primary Examiner*—Alexander Thomas

*Attorney, Agent, or Firm*—Frank A. Lukasik

[57] ABSTRACT

The combination of a backspin sticker and a golf club having an angled surface for increasing the backspin of a golf ball when it hits the putting surface. The invention is a sticker, shaped to conform to a hitting area on the hitting surface, the sticker having a front surface with a coating of silicon carbide grain affixed with a synthetic resin and an adhering region having a clear, pressure sensitive adhesive applied thereon, and a release liner adhered to the adhesive for preserving the adhesive qualities.

5 Claims, 3 Drawing Sheets

BACKSPIN STICKER

BACKGROUND OF THE INVENTION

1. Field of the Invention

This invention relates generally to golf clubs and more particularly to a club face affixed to a golf club that has more backspin for extra stopping power on the green.

2. Background of the Invention

With the current state of the art golf equipment, golfers first purchase a golf bag and clubs, take them out on the course and then continue trying to improve their game. Golf club manufacturers are also continually spending millions of dollars on developing new materials, shapes and weights of golf clubs to improve the golfer's score. Much of the development of golf clubs involves the design of the face of the club. In particular, drivers are being developed which are made from stainless steel while the face of the club is made from titanium.

The design of irons have generally been limited to the shape of the face of the club or perimeter weighting to provide a better, more even distribution of weight behind the ball. In addition, there are hundreds of different face designs to further control the flight of the golf ball. One such club is advertised to have a patented "invisible" curve (you can feel it, but barely see it) across their hitting surface that tames the stronger "gear" effect and draws off-center shots back to the middle of the fairway. As far as can be determined, there are no irons manufactured with a stainless steel body and a titanium face insert.

Another example of a golf club made of two different materials, is a putter made of CORIAN, a machineable polymer developed by E. I. Dupont. The CORIAN putters are lighter than metal putters. In addition, the brass weights in the heel and toe of the putter offers balance and a large sweet spot.

Although there do not appear to be any dual-metal irons, designers attempt to influence the flight of the ball by altering the hitting surface, the face of the iron. The majority of the irons contain narrow, rectangular grooves running horizontally across the face of the club. The theory of the operation of the grooves is that as the face strikes the ball, the grooves will engage the slightly flattened surface of the struck ball and impart a slight spin as the ball is impacted.

The amount of spin will increase slightly with an increase in the angle of the face to the vertical. For example, the spin created by the pitching wedge will be greater than the spin created by the face of a two iron, etc. Although the grooves do provide a slight degree of spin, repeated hitting of divots while striking the ball, fills the grooves with soil thus making them ineffective. Elaborate tools are required to regularly clean out the grooves to make them more effective.

SUMMARY OF THE INVENTION

The invention is a specially designed sticker made from a very thin, but high impact, firm, water resistant paper, foil or other similar material. The front surface of the sticker has a coat of a silicon carbide grain, fixed with a synthetic resin. The back surface of the sticker has a high performance pressure sensitive adhesive and a release liner for protecting the adhesive until used by a golfer.

In practice, when a golfer reaches a point on the fairway where he can hit the green on the next shot, he takes the sticker, removes the release liner and adheres the sticker to the face of the club. When the golfer hits the ball with the front surface, the friction of the carbide grain grips the ball as it crosses the face of the club and the ball begins to spin as it leaves the face of the club. When the ball completes its arc toward the green, it continues spinning until it hits the green where the backspin takes effect and the ball reverses its direction of roll. The sticker may be used repeatedly if desired but it may be removed when the golfer decides that a backspin is not desirable. When the situation calling for a backspin occurs again, a new sticker may be applied as described above.

DESCRIPTION OF THE PREFERRED EMBODIMENT

Figure 2:
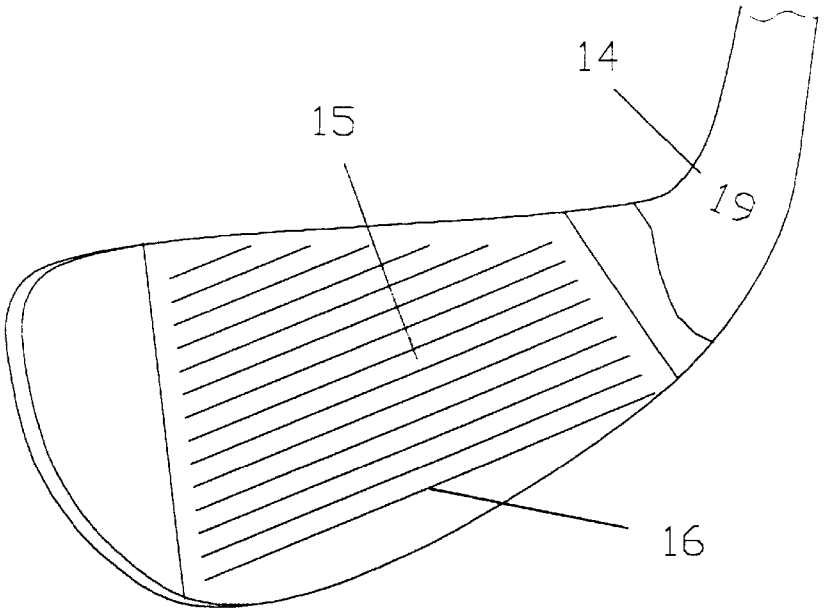
FIG. 2 is a perspective view of a golf club face depicting grooves formed in a conventional golf club.
Figure 1:
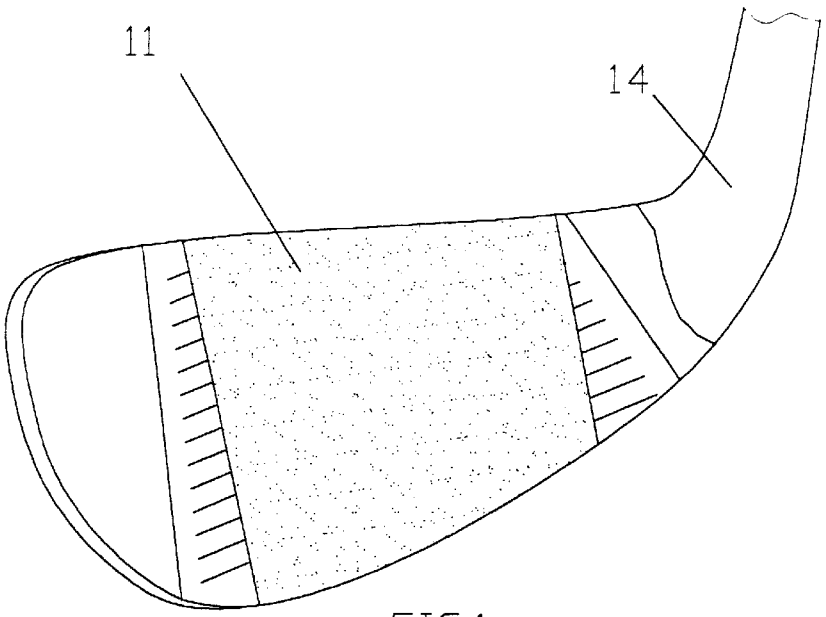
FIG. 1 is a front perspective view of a golf club face having a backspin sticker of the invention affixed thereon.
Figure 3:
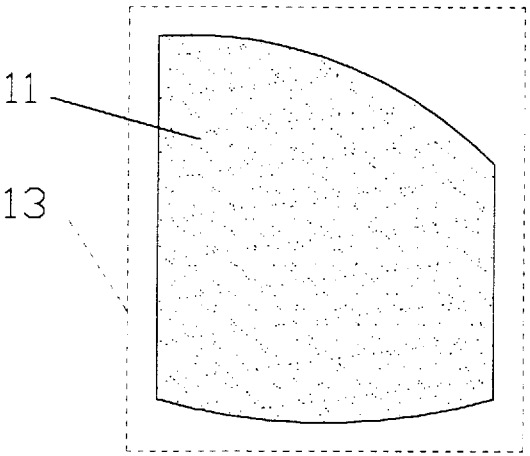
FIG. 3 is a front view of a backspin sticker of the invention.
Figure 4:
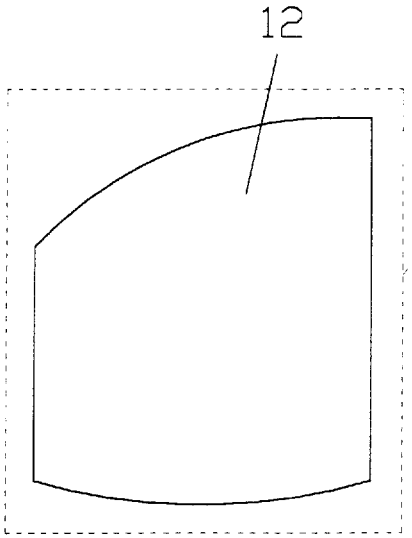
FIG. 4 is a backside view of a backspin sticker of the invention.

Referring to FIG. 1, there is shown the backspin sticker of the invention denoted generally by the numeral 10. The sticker 10 is formed in a shape to generally fit the sweet spot of face 15 of the golf club 14. Horizontal, rectangular shaped grooves 16 are formed across the face 15.

Figure 5:
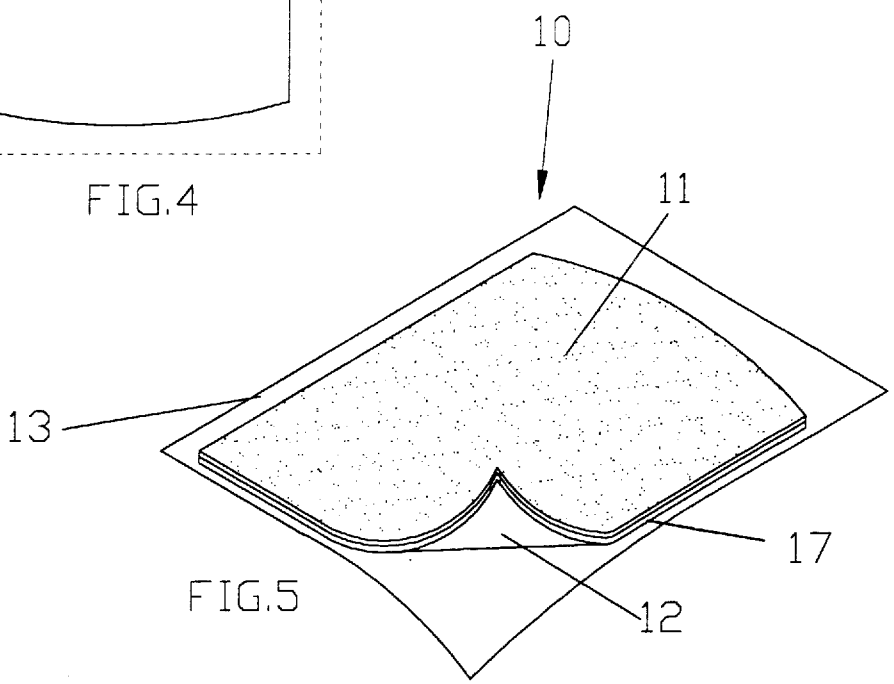
FIG. 5 is a top perspective view of the backspin sticker showing the sticker being removed from the release liner.

The backspin sticker 10 is preferably formed of a face stock 17 having an adhering region, back side 12, and a front side 11. Sticker 10 is shaped as shown in FIG. 5 which shows structure of the sticker 10 showing the coat of silicon carbide grain formed with a synthetic resin on front side 11. The manufacture of the backspin sticker 10 may be accomplished on a web press and begins with passing a continuous web of face stock 17 through the silicon carbide applicator and coating the front side 11. The face stock 17 is then passed through a hot melt applicator and a coating is applied at back side 12 with a clear, pressure sensitive, adhesive. After the adhesive application step is completed, the face stock 17 is combined with release liner 13 between a set of combining rollers.

When the coating processes are completed, face stock 17, combined with release liner 13, are then passed through a set of die cut rollers where the backspin stickers 10 are cut to shape.

In a preferred embodiment, the grain 11 consisted of a #400 silicon carbide grain. The grain is affixed to a water proof paper or aluminum foil sheet 17 with a synthetic resin. A hot melt self adhesive 12 is applied to the back side of sheet 17 and then sheet 17 is united with a release liner 13. Release liner 13 may consist of a silicone coated polypropylene film that exhibits consistent release properties and is extremely resistant to tearing and breaking.

The backspin stickers 10 are then packaged in groups and sold in pro shops and golf supply houses. The golfer will carry a package of backspin stickers 10 in his bag and when he feels that a large backspin is required, he will peel off the release liner and adhere the backspin sticker 10 to the face 15 of the golf club 14. The sticker 10 may be left on the club 14 and used repeatedly until the grain is filled with soil or is worn off. The sticker 10 may then be removed and replaced by another one.

Figure 6:
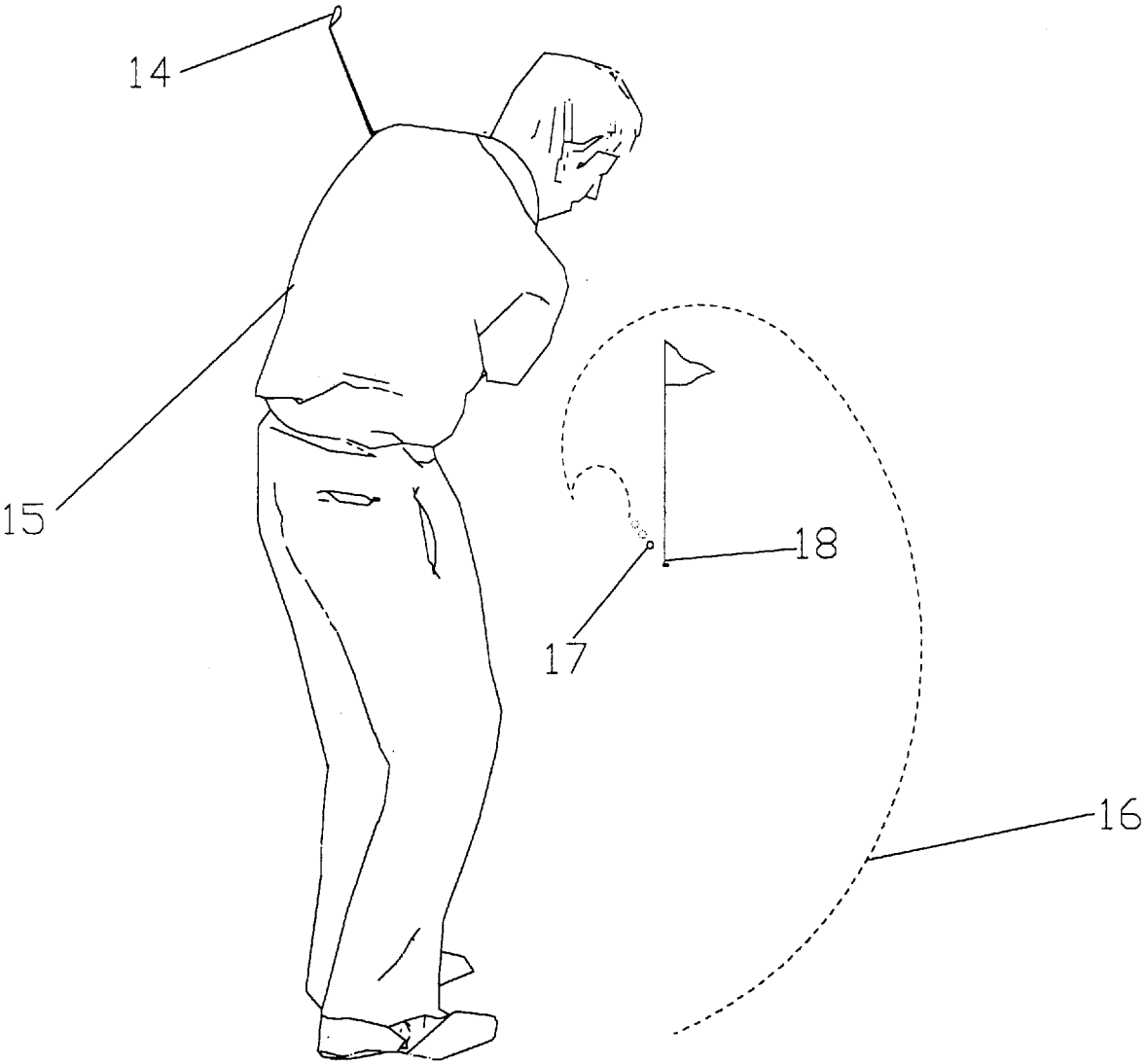
FIG. 6 is a top perspective view of a golfer hitting a ball and the backspin of the ball on the green.

FIG. 6 is a perspective view of the golfer 19 hitting a ball 17 and the backspin of the ball 17 on the green as it approaches the hole 18. The arc of the ball 17 is shown by the numeral 16.

One of the advantages of the invention is that a golfer does not have to carry as many different golf clubs in his bag and will save a considerable amount of money which he would have to spend on a number of different wedges for different situations. If a golfer needs to play a golf ball with a high backspin, he need only take one of the backspin stickers 10 out of the golf bag and stick it on one of the regular wedges or irons that he likes to play with.

Obviously, many modifications and variations of the present invention are possible in light of the above teachings. It is therefore to be understood that within the scope of the appended claims, the invention may be practiced otherwise than as specifically described.

What is claimed is:

1. The combination of a backspin sticker and a golf club having an angled hitting surface, said combination comprising:

a face stock having an adhering region and a front surface, said face stock being shaped to conform to a hitting area on said hitting surface, a coating of silicon carbide grain affixed to said front surface by a synthetic resin, a coating of a clear, pressure sensitive adhesive applied to said adhering region, and a release liner adhered to said adhesive for preserving the adhesive qualities for adhering to said angled hitting surface when desired to improve the performance of said hitting surface.

2. The combination of claim 1 wherein said face stock consists of waterproof paper.

3. The combination of claim 1 wherein said face stock consists of aluminum foil.

4. The combination of claim 1 wherein said silicon grain coating consists of a #400 silicon carbide grain.

5. The combination of a backspin sticker and a golf club having an angled hitting surface, said combination comprising:

a waterproof, paper face stock having an adhering region and a front surface, said face stock being shaped to conform to a hitting area on said hitting surface, a coating of # 400 silicon carbide grain affixed to said front side by a synthetic resin, a coating of a hot melt clear, pressure sensitive adhesive applied to said adhering region, and a release liner adhered to said adhesive for preserving the adhesive qualities for adhering to said angled hitting surface when desired to improve the performance of said hitting surface.

* * * * *